United States Patent [19]

Gutierrez

[11] 3,952,457

[45] Apr. 27, 1976

[54] DUAL SURFACE ARTICLE ABRADING APPARATUS

[76] Inventor: Thomas Gutierrez, 395 Madison St., Santa Clara, Calif. 95050

[22] Filed: Mar. 4, 1974

[21] Appl. No.: 448,000

[52] U.S. Cl. ..... 51/66; 51/354
[51] Int. Cl.² ..... B24B 7/00
[58] Field of Search ..... 51/40, 66, 354, 119

[56] References Cited

UNITED STATES PATENTS

| | | | |
|---|---|---|---|
| 892,231 | 6/1908 | Gidam | 51/66 |
| 1,909,743 | 5/1933 | Blankner | 51/354 |
| 1,962,766 | 6/1934 | Crowley | 51/66 X |
| 2,269,197 | 1/1942 | Hamilton | 51/40 |
| 2,384,164 | 9/1945 | Gerung | 51/66 |
| 2,481,588 | 9/1949 | Hamilton | 51/40 |
| 2,548,979 | 4/1951 | Johnson | 51/66 |
| 2,692,459 | 10/1954 | Gerung | 51/66 |
| 2,945,330 | 7/1960 | Peyches | 51/119 |

*Primary Examiner*—Harold D. Whitehead
*Attorney, Agent, or Firm*—Thomas Schneck

[57] ABSTRACT

The invention is a machine having a reciprocating carriage for abrading both sides of a flat article which is transmitted to the carriage through a series of pinch rollers. The carriage carries an abrading tool with floating abrading surfaces such that the flat articles can pass between the surfaces, yet remain in contact with them. Spring tension keeps the abrading surfaces in contact with flat articles to be abraded.

9 Claims, 8 Drawing Figures

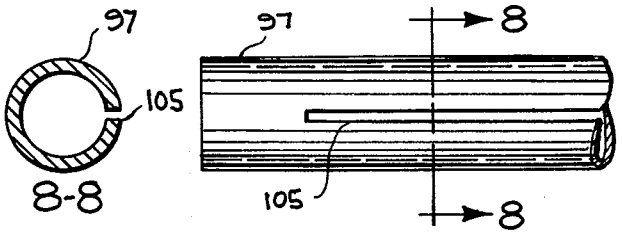
Fig. 7
Fig. 8
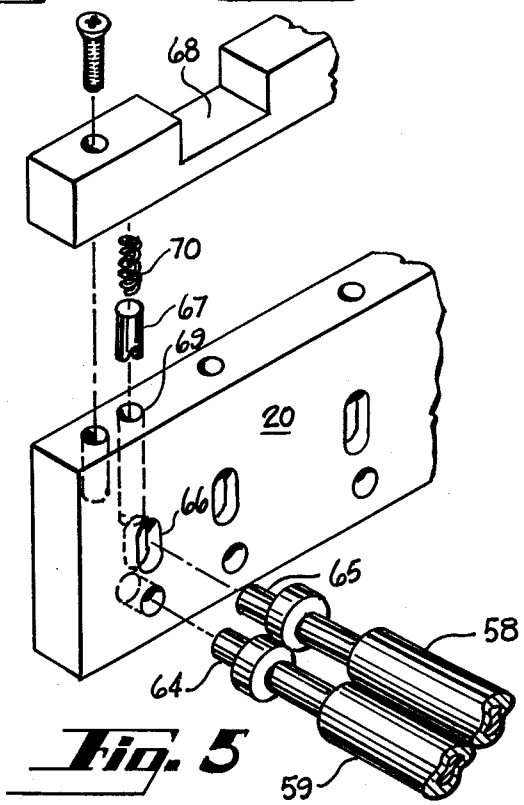
Fig. 5
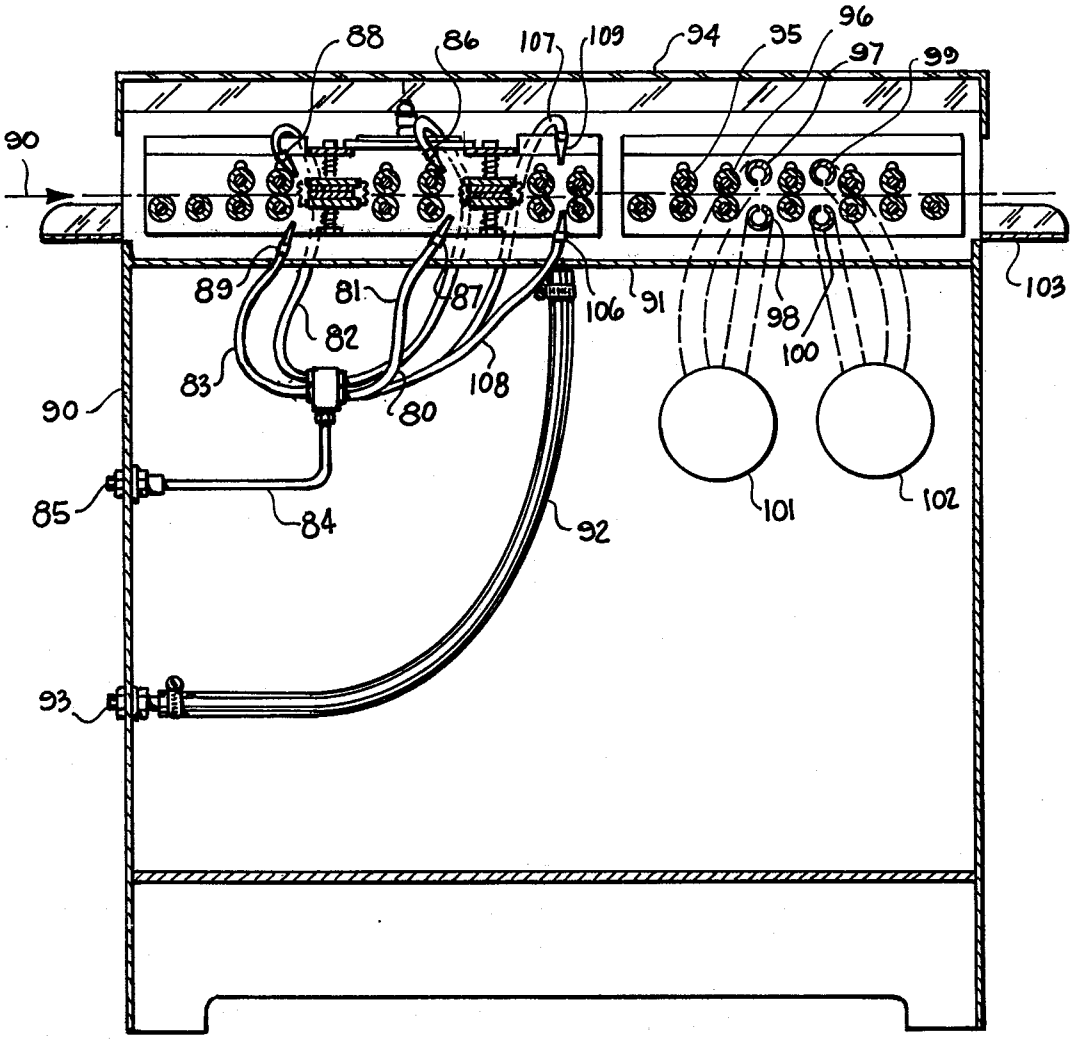
Fig. 6

DUAL SURFACE ARTICLE ABRADING APPARATUS

FIELD OF THE INVENTION

The invention relates to article abrading machines and more particularly to a machine for abrading both sides of flat articles.

PRIOR ART

Article abrading devices for a single side of a flat article are known. For example, see U.S. Pat. No. 3,734,700, to Thomas Gutierrez and Wallace Amaral, granted May 22, 1973, for Article Abrading Apparatus. When such a device is used for abrading both sides of a flat article, for example, a printed circuit board, it is necessary to send the article through the apparatus two times, once for abrasion of each side. It has long been recognized that an apparatus which abraded both sides of a flat article would be useful.

In response to this need, machines have been developed which use a pair of rotating opposed cylinders to abrade articles passing between the rotating cylinders. The problem with this class of device is that the rotating cylinders must be adjusted carefully. Articles to be abraded act as a lathe tool as they come into contact with the rotating cylinder and, hence, they tend to wear out rather rapidly and are usually expensive and laborious to replace.

A further problem with the prior art cylindrical abrading tools is that they are limited with respect to their ability to handle small articles. Cylindrical abrading tools also require almost continuous adjustment and consume relatively large amounts of electrical energy. Furthermore, cylindrical abrading tools are usually kept with a higher abrading pressure than necessary as the abrading surface decreases in efficiency due to wear. This necessitates changing pressure adjustments.

Accordingly, it has been an object of this invention to find an apparatus for abrading both sides of flat articles with a tool having abrading surfaces which will not wear out as rapidly, nor be as expensive or laborious to replace as those found in the prior art.

A further object of the invention is to devise an abrading apparatus which can process smaller articles than has heretofore been possible with cylindrical abrading devices.

A further object is to develop a dual surface abrading apparatus which is self adjusting and uses less power than prior art abrading devices.

A further object is to develop a dual surface abrading apparatus which maintains uniform abrading pressure on an article to be abraded.

SUMMARY OF THE INVENTION

The above objects are achieved with an abrading apparatus having an article abrading tool which includes a carriage mounted for reciprocal motion transverse to the line of travel of flat articles presented to the abrading tool by a feed means. A feed means receives flat articles and advances them in a line of travel toward the abrading tool. Following the line of travel, articles pass into the abrading tool between a first pair of opposed abrading surfaces. The aforementioned abrading surfaces are suspended on a first carriage at an elevation such that the line of travel of the flat articles passes between the pair of abrading surfaces.

As a flat article passes through the abrading tool, power is applied to a reciprocating member which provides reciprocal motion to the carriage, so that the article abrading surfaces transversely pass across the flat articles being processed. Uniform spring tension is maintained on the abrading surfaces for keeping them in contact with the flat articles. The abrading surfaces may be either flat or cylindrical. In either case, the abrading surfaces reciprocate in a direction transverse to the line of travel of the flat articles. If the abrading surfaces are cylindrical, they may be hinged for free rotation, but the principal abrading action is a reciprocating transverse motion, not a rotary motion. By this rotary motion, the effectiveness of the abrading surfaces is enhanced, thereby extending even more the life of said surfaces. Furthermore, the abrading tool is easily removable from the complete abrading machine, such that changing of abrading surfaces, when necessary, is simplified.

The abrading apparatus is provided with a fluid bath means adjacent to the line of travel of the articles to be abraded for washing both sides of the articles and for wetting the abrading tool. The fluid bath means consists of a number of hoses directing a fluid stream on to the boards prior to entry into the abrading tool.

The apparatus is further provided with article drying means which consist of air jets which direct a linear air jet across the boards, i.e. transverse to the line of travel, at locations above and below the line of travel.

The finished boards emerge from the apparatus having been washed, abraded on both sides, and dried.

DESCRIPTION OF THE DRAWINGS

FIG. 5 is an exploded detail view of the feed means construction of the apparatus of FIG. 1.

FIG. 6 is a side view of the apparatus of FIG. 1 with cover in place.

FIG. 7 is a partial bottom view of the air jet means shown in FIG. 6.

FIG. 8 is a side sectional view taken along the lines 8 — 8 in FIG. 7.

DESCRIPTION OF THE PREFERRED EMBODIMENT

Figure 1:
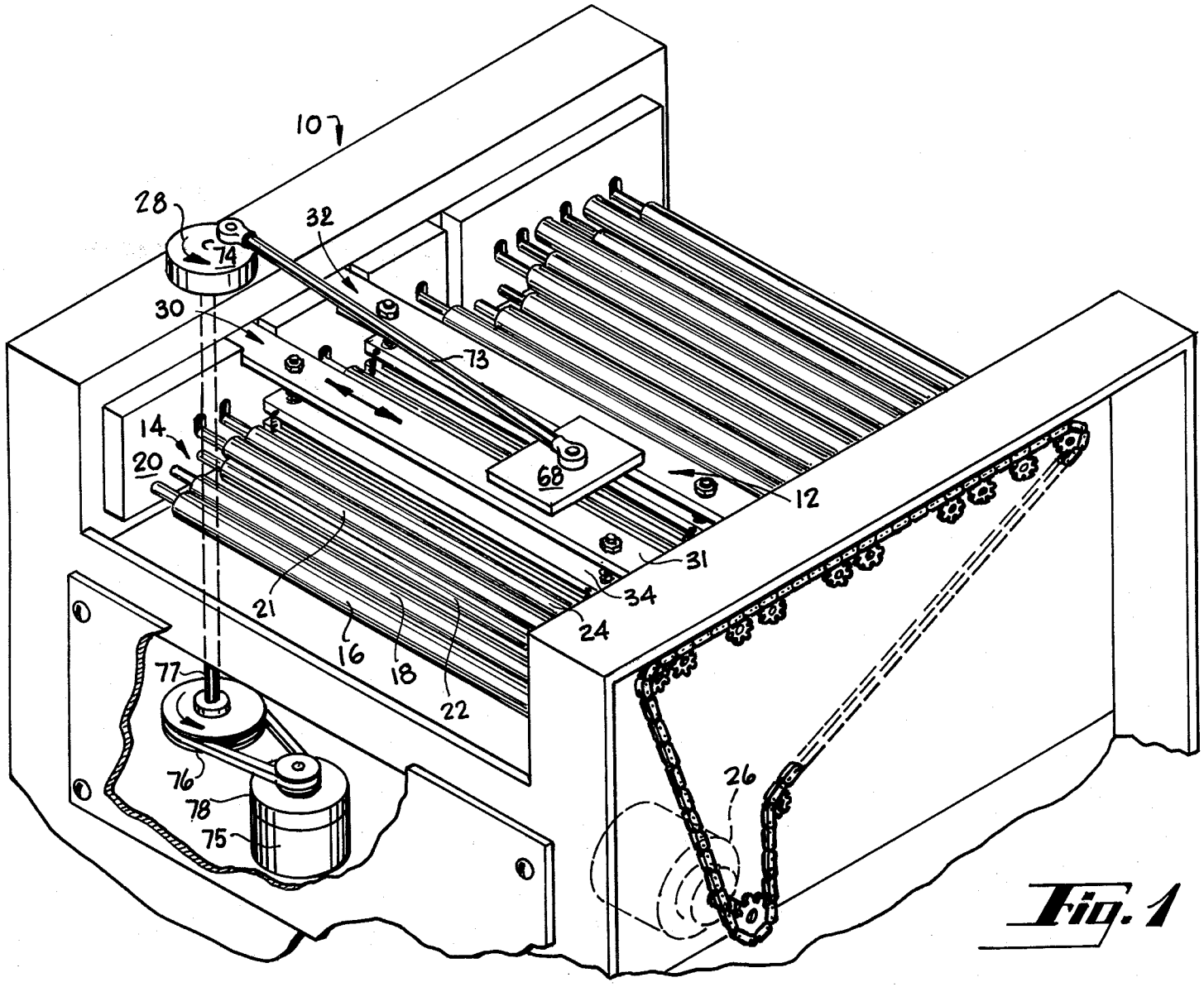
FIG. 1 is a partial perspective view of the apparatus disclosed herein, with its cover removed and not shown.

In FIG. 1, the article abrading apparatus 10 includes an article abrading tool 12 which reciprocates in the direction shown by the arrowheads on the tool 12.

Articles to be abraded are placed in the feed means 14. Feed means 14 generally consists of sets of pinch rollers. However, a direction of travel is first defined by a pair of rollers 16, 18 which allow placement of flat articles thereon and provide support for these articles. The rollers 16, 18 are free to rotate along a central axes of symmetry. The ends of each roller are mounted in a shaft retaining member 20 which is preferably a low friction block, such as Teflon, a trademark for polytetraflouroethylene, thereby obviating the need for shaft bearings. An article placed on the free spinning rollers 16, 18 is pushed forward until it passes between a first pair of opposed driven pinch rollers 21, 22. Lower roller 22, is in the same horizontal plane as the feed rollers 16, 18. A second set of pinch rollers including the upper pinch roller 24 is located immediately behind rollers 22, 22. An article to be abraded passes between pinch rollers 21, 22 toward the abrading tool 12. A motive means 26, a motor, provides the rotary force necessary to drive the lower roller 22 of feed means 14.

The article abrading tool 12 is connected to a power means 28 for providing reciprocal motion to the abrading tool. The abrading tool 12 includes a first carriage 30 and a second carriage 32. The first carriage 30 has a first support bar 31 from which a pair of opposed article abrading surfaces 34, 35 are suspended, and are described below with reference to FIG. 3. Support bar 31 is mounted in an aperture in the low friction shaft retaining block 20. The construction of the abrading tool 12 is shown in more complete detail in FIG. 2.

Figure 2:
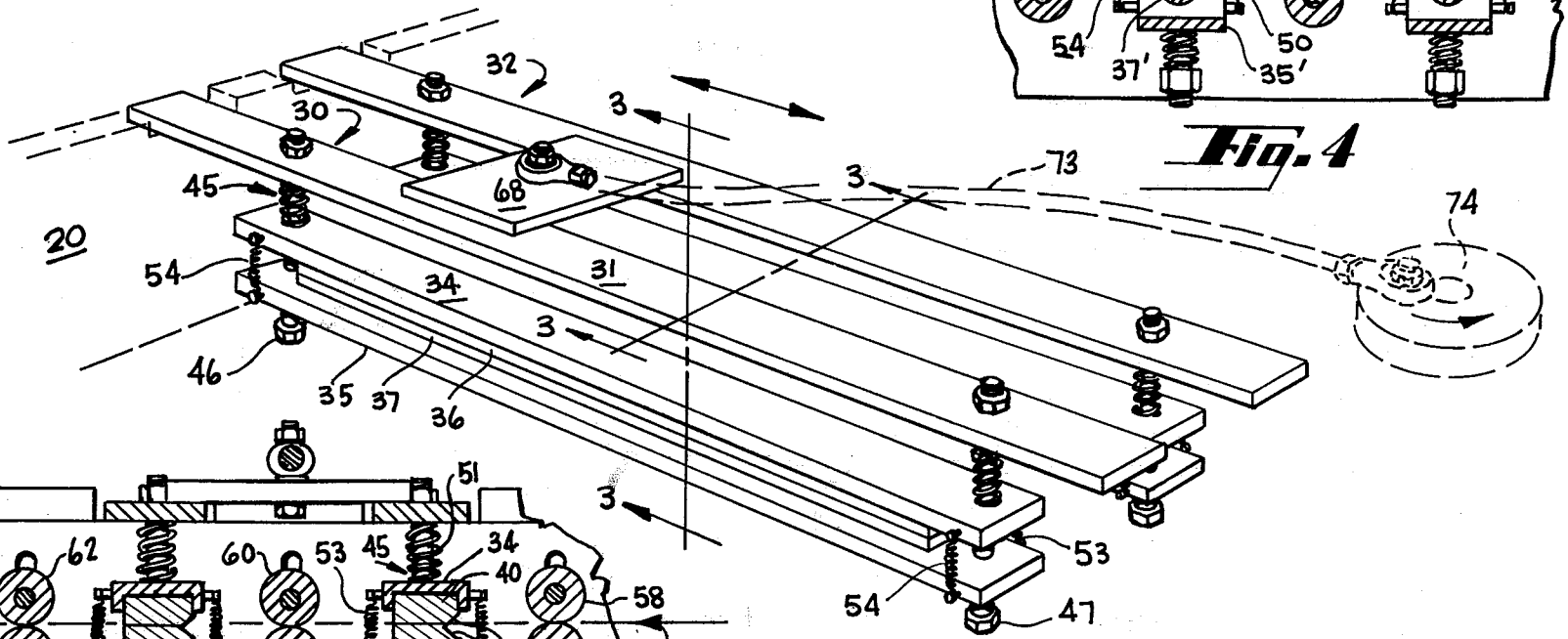
FIG. 2 is a detailed perspective view of the abrading tool of the apparatus in FIG. 1.

In FIG. 2, the first pair of article abrading surfaces 34, 35 consist of elongated members having mutually facing abrasion materials 36, 37 adhered to the respective operative surfaces 34, 35. For example, the abrasion materials 36, 37 may be elongated abrading blocks which are adhesively connected to the abrasion surfaces 34, 35 for removable replacement thereon. The abrading blocks are preferably made of a resilient member which is generally rectangular in cross-section, except for a slightly chamfered edge facing the direction of travel of an incoming flat article to be abraded. This is more clearly illustrated in FIG. 3, a sectional view.

Figure 3:
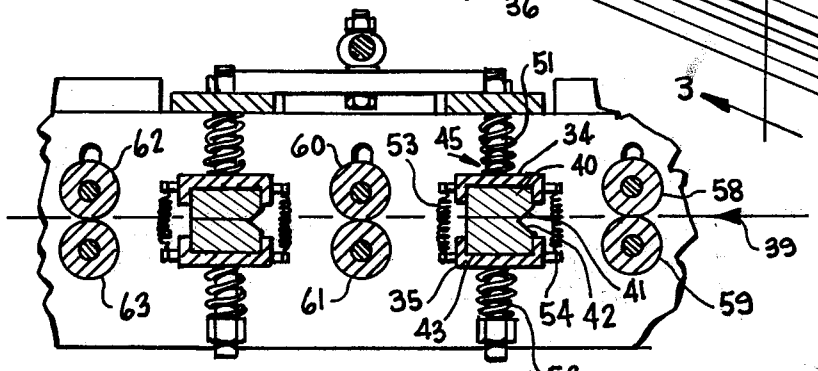
FIG. 3 is the sectional view taken along the lines 3 — 3 in FIG. 2.

In FIG. 3, the line of travel of a flat article is shown by an arrowhead 39. A first abrading block 40 associated with the abrading surface 34 is shown to have an inwardly chamfered edge 41 for facing a correspondingly chamfered edge 42 of abrading block 43 associated with the abrading surface 35.

The two abrading surfaces 34, 35 are connected to the first carriage 30 by a suspension means 45, in FIGS. 2 and 3. The suspension means includes rods 46, 47 extending from the support bar 31 and through colinear apertures in opposed abrading surfaces 34, 35. Edge springs 53, 54 comprising a second spring means tend to force the abrading surfaces 34, 35 to converge inwardly thereby applying force to the article to be abraded. A pair of springs 51, 52 comprising a first spring means help keep opposed abrading surfaces 34, 35 parallel and centered. A flat article entering the chamfered region of the abrading material causes abrading surfaces 34, 35 to uniformly spread in a vertical plane as a unit.

FIG. 3 further illustrates opposed pairs of pinch rollers which drive flat articles into the chamfered regions of the respective sanding blocks. Pairs of pinch rollers 58, 59; 60, 61; 62, 63; each have a driven member, usually the lower pinch roller 59, 61, 63 respectively turned by a motor, i.e. motor 26 in FIG. 1, with each lower roller urged upwardly by a spring, not shown. The opposite corresponding pinch rollers 58, 60, 62, respectively, are urged downwardly by springs, shown in FIG. 5, and by gravity for a positive control of the motion of a flat article which may be passing between such rollers.

Figure 4:
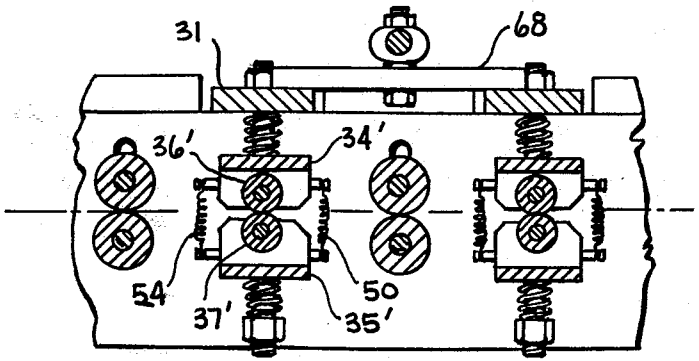
FIG. 4 is an alternate construction for the abrading surfaces shown in FIG. 3.

FIG. 4 illustrates an abrading tool in which abrading surfaces 34', 35' have paired cylindrical abrasion materials 36', 37' mounted thereon. The surfaces 34', 35' are free to rotate if urged by an article passing therebetween. However, surfaces 34', 35' are not driven, in contrast to prior art cylindrical abrasion tools which generally are driven.

FIG. 5 illustrates a means of maintaining the pinching effect exhibited by the pinch rollers described herein. A lower, driven roller 59 has a shaft 64 which extends into a mounting block 20. It is driven by an external source, such as motor 26, shown in FIG. 1. An upper pinch roller 58 has a shaft 65 which fits into an aperture 66 immediately above the location where the lower roller 59 is mounted. The aperture for receiving shaft 65 is elongated completely through block 20 allowing for upward motion of the roller. Simultaneously, a downward bias is exhibited on shaft 65 by a spring 70 which pushes downwardly on a follower member 67. The spring and follower are held in place by a cap member 68 which covers the top of a slot 69 wherein the follower 67 and the spring 70 reside. The enlargement of aperture 66 allows pinch roller 58 to ride upwardly when a flat article of considerable thickness passes between pinch rollers 58, 59.

In FIG. 1, the first and second carriages 30, 32 are united by means of a drive block 68 to which is connected a drive arm 73 which in turn is connected to a cam 74, all comprising parts of the power means 28 which cause reciprocating motioned for the tool 12. Reciprocating power is ultimately obtained from the motor 75 and gear box 78 which transmit torque through a pulley 76 to a drive shaft 77.

FIG. 6 shows a side sectional view which illustrates the article cleaning features of the present apparatus. A series of fluid bath members 80, 81, 82, 83, 107, 108 are connected to a fluid source 84. A hose connection 85 is provided at an exterior wall 90 of the housing for supplying cleaning fluid, e.g., water. The fluid bath means direct fluid at both upper and lower surfaces of a flat article being wetted by means of nozzles 86, 87, 88, 89, 106, 109 at respective positions above and below the line of travel of a flat article indicated by the arrow 90.

a drain pan 91 collects fluid which drops after it has been directed against an article to be abraded, or any other obstacle in its path. A drain hose 92 is located at a low point in the drain pan 91 for fluid collection by runoff. A drain connection 93 is provided at exterior wall 90.

A cover member 94 fits over the top of the apparatus for retaining fluid within the immediate confines of the machine. When the material removed from flat articles consists of metallic powders of valuable materials, the drain material may be filtered to remove any such valuable substances. For example, printed circuit boards are often plated with gold and silver. In many instances it is desirable to recover such precious metals and this can easily be done by removal of particles by filtering the runoff from the cleaning operation. The fluid bath is provided not only for purposes of cleaning but equally important, for purposes of lubricating the abrasion process. Just before each board enters between the abrading surfaces of an abrading tool, fluid is provided on the surface of the board for reducing the total amount of friction which would otherwise occur.

After a flat article passes through the abrading tool, it passes underneath a further pinch roller 95, 96 and then between the linear air jet means 97, 98; 99, 100. The linear air jet means comprise tubes having longitudinal slits therethrough and sealed at one end. See FIGS. 7 and 8. The opposite end is open and connected to high velocity, high pressure air blowers, 101, 102 of the type commonly found in vacuum cleaners. Air pressure from such blowers is boosted as the air passes through the longitudinal slit 105 and the combination of high pressure and high velocity creates an air jet which blasts a flat article with sufficient air to dry the article. The moisture eventually condenses and returns to pan 91 and is eventually collected by drain 92. The dry boards emerge from between the last pinch rollers in their line of travel and are removed from the housing from a shelf 103.

It will be realized that the terms upward, downward, inward, outward, and vertical, horizontal, as used herein are relative and that no absolute directions are implied.

I claim:

1. Apparatus for abrading both sides of flat articles comprising, feed means for receiving flat articles, said feed means having motive means connected thereto for advancing flat articles in a line of travel, an abrading tool having a first carriage mounted adjacent said feed means for reciprocal motion transverse to said line of travel, said first carriage having a first pair of opposed article abrading surfaces and having a first spring means for suspending said first pair of article abrading surfaces on said first carriage in a floating upward and downward relationship to said flat articles at an elevation proximate to the line of travel of said flat articles between said pair of surfaces, and having a second spring means compressibly connecting opposed ends of said first pair of opposed article abrading surfaces, and power means for providing reciprocal motion to said carriage.

2. The apparatus of claim 1 wherein said abrading surfaces are coextensive flat surfaces, each mounted for motion contacting the entirety of said flat articles in the direction transverse to said line of travel.

3. The apparatus of claim 1 wherein said abrading surfaces are coextensive cylinders mounted for free rotation.

4. The apparatus of claim 1 wherein said carriage is further defined by a first support bar connected to said first pair of opposed article abrading surfaces, said support bar having said first spring means mounted thereon for suspending said abrading surfaces from said first support bar.

5. The apparatus of claim 1 wherein said abrading tool further includes a second carriage having a second support bar, a second pair of opposed article abrading surfaces and first spring means for suspending second pair of article abrading surfaces on said second carriage at an elevation such that said line of travel is approximately between said pair of surfaces.

6. The apparatus of claim 1 further including a fluid bath means located adjacent said line of travel in a position for bathing said flat articles and said abrading tool and fluid drying means located proximate to said bath means and in a position for receiving said flat articles subsequent to abrading by said abrading tool, at locations above and below said line of travel.

7. The apparatus of claim 6 wherein said fluid drying means includes linear air jet means for directing a linear jet of air transverse to said line of travel at locations above and below said line of travel.

8. The apparatus of claim 6 further including a housing for capturing said fluid from said drying means, said housing having a drain for removing said fluid.

9. The apparatus of claim 1 wherein said feed means includes cylindrical rollers mounted in a retaining member have a coefficient of friction at least as low as polytetrafluoroethylene.

* * * * *